US011764022B2

(12) United States Patent
Long et al.

(10) Patent No.: US 11,764,022 B2
(45) Date of Patent: Sep. 19, 2023

(54) SLIM CIRCUIT BREAKER

(71) Applicant: Carling Technologies, Inc., Plainville, CT (US)

(72) Inventors: Guiheng Long, Zhongshan (CN); Michael Fasano, Watertown, CT (US)

(73) Assignee: Carling Technologies, Inc., Plainville, CT (US)

( * ) Notice: Subject to any disclaimer, the term of this patent is extended or adjusted under 35 U.S.C. 154(b) by 86 days.

(21) Appl. No.: 17/241,471

(22) Filed: Apr. 27, 2021

(65) Prior Publication Data

US 2022/0344120 A1 Oct. 27, 2022

(51) Int. Cl.

| | |
|---|---|
| ***H01H 71/54*** | (2006.01) |
| ***H01H 71/02*** | (2006.01) |
| ***H01H 23/02*** | (2006.01) |
| ***H01H 73/52*** | (2006.01) |

(52) U.S. Cl.

CPC ..... *H01H 71/54* (2013.01); *H01H 23/02* (2013.01); *H01H 71/0264* (2013.01); *H01H 73/52* (2013.01)

(58) Field of Classification Search

CPC .... H01H 71/54; H01H 71/0264; H01H 23/02; H01H 73/52

USPC ..... 200/237

See application file for complete search history.

(56) References Cited

U.S. PATENT DOCUMENTS

| | | | | |
|---|---|---|---|---|
| 3,706,058 | A | 12/1972 | Hopkinson | |
| 6,175,288 | B1 * | 1/2001 | Castonguay | H01H 71/2472 335/16 |
| 6,864,451 | B1 | 3/2005 | Slepian | |
| 9,318,284 | B2 | 4/2016 | Fasano et al. | |
| 9,947,499 | B2 | 4/2018 | Lin et al. | |
| 10,211,003 | B1 * | 2/2019 | Fasano | H01H 9/02 |
| 10,510,506 | B1 | 12/2019 | Fasano | |
| 2006/0070864 | A1 * | 4/2006 | Ferreira | H01H 71/58 200/400 |
| 2008/0135524 | A1 * | 6/2008 | Behrens | H01H 33/765 218/150 |
| 2018/0240636 | A1 * | 8/2018 | Pan | H01H 3/38 |

(Continued)

FOREIGN PATENT DOCUMENTS

EP 3343587 A1 7/2018

OTHER PUBLICATIONS

International Search Report and Written Opinion dated Aug. 12, 2022 for PCT/US2022/026469 filed Apr. 27, 2022.

*Primary Examiner* — Thienvu V Tran
*Assistant Examiner* — Sreeya Sreevatsa
(74) *Attorney, Agent, or Firm* — KDW Firm PLLC

(57) ABSTRACT

A circuit breaker design allows for the circuit breaker to have an overall height (i.e., measured vertically along the circuit breaker's exposed outwardly-facing surface in the typical orientation of circuit breaker panels) that is slimmer than achievable with known typical configurations, while at the same time still providing robust power (e.g., voltage) handling and arc interruption capabilities. This is achieved, for example, by providing various components formed from polymer materials (which are generally less conductive of heat than metals), reinforced by metal members in certain areas, if needed, as well as a very particular configuration of a permanent magnet that is employed for enhanced arc quenching.

8 Claims, 4 Drawing Sheets

(56) References Cited

U.S. PATENT DOCUMENTS

| | | | | |
|---|---|---|---|---|
| 2019/0074153 | A1 | 3/2019 | Fasano | |
| 2019/0189379 | A1* | 6/2019 | Ostrovsky | H01H 33/02 |

* cited by examiner

SLIM CIRCUIT BREAKER

FIELD OF THE INVENTION

The invention relates to the field of circuit breakers. More specifically, the invention relates to a circuit breaker having an improved design that allows for a more compact, slim circuit breaker as compared to typical circuit breaker designs, while at the same time still allowing the circuit breaker to handle relatively high voltages.

BACKGROUND OF THE INVENTION

Circuit breakers are extremely well known and have been in widespread use for decades. They are generally used in an electrical panel that monitors and limits the amount of current (amperage) being sent through the electrical wiring. A circuit breaker is designed to protect an electrical circuit from damage caused by an overload or a short circuit. If a power surge occurs in the electrical wiring, the breaker will trip. This will cause a breaker that was in the "on" position to flip to the "off" position and shut down the electrical power leading from that breaker. When a circuit breaker is tripped, it may prevent a fire from starting on an overloaded circuit; it can also prevent the destruction of the device that is drawing the electricity.

A standard circuit breaker has a line terminal and a load terminal. Generally, the line terminal is in electrical communication with a supply of incoming electricity, most often from a power company or generator. This can sometimes be referred to as the input into the circuit breaker. The load terminal, sometimes referred to as the output, feeds out of the circuit breaker and connects to the electrical components being fed from the circuit breaker. There may be an individual component connected directly to a circuit breaker, for example only an air conditioner, or a circuit breaker may be connected to multiple components through a power wire which terminates at electrical outlets.

A circuit breaker can be used as a replacement for a fuse. Unlike a fuse, which operates once and then has to be replaced, a circuit breaker can be reset (either manually or automatically) to resume normal operation. Fuses perform much the same duty as circuit breakers, however, circuit breakers are safer to use than fuses and easier to fix. If a fuse blows, oftentimes a person will not know which fuse controls which specific power areas. The person will have to examine the fuses to determine which fuse appears to be burned or spent. The fuse will then have to be removed from the fuse box and a new fuse will have to be installed.

Circuit breakers are much easier to fix than fuses. When a circuit breaker trips, one can easily look at the electrical panel and see which breaker actuator has moved to the tripped position. The circuit breaker can then be "reset" in many cases by turning the actuator to the "off" position, and then moving the actuator to the "on" position.

In general, a circuit breaker has two contacts located inside of a housing. The first contact is typically stationary, and may be connected to either the line terminal or the load terminal (often, the line terminal). The second contact is typically movable with respect to the first contact, such that when the circuit breaker is in the "off", or tripped position, a physical gap exists between the first and second contacts. The second contact may be connected to whichever of the line terminal or the load terminal that the first contact is not connected to (often, the second contact is connected to the load terminal).

To trip the circuit breaker so as to open the circuit, an overcurrent sensor may be provided (such as, for example, a hydraulic magnetic overcurrent sensor or a thermal overcurrent sensor) or a solenoid type trip mechanism with an overcurrent sensor may be used. When the overcurrent sensor senses a current level above a threshold level, which may, for example, be a percentage above the rated current of the circuit breaker, the overcurrent sensor or solenoid may be actuated to mechanically move the second contact away from the first contact, thereby tripping the circuit breaker to open the circuit.

A problem with a traditional circuit breaker, however, is that even though it may be in the open position, i.e. the circuit breaker has tripped, interrupting the connection, the open area between the first and second contact allows an electrical arc to form between the two contacts, particularly right as the contacts are opening, or just prior to their closing. The electrical arc may have a high voltage and/or amperage, and as such can be dangerous; they can cause damage to the circuit breaker, specifically damaging the electrical contacts, linkages or other moveable components. Any damage to the electrical contacts or other components shortens the lifespan of the circuit breaker and affects its performance.

Another effect of arcing stems from the extremely high temperature of the arc (perhaps tens of thousands of degrees Celsius), which can impact the surrounding gas molecules creating ozone, carbon monoxide, and other dangerous compounds. The arc can also ionize surrounding gasses, potentially creating alternate conduction paths.

Because of these detrimental effects, it has been recognized to be very important to quickly cool and quench the arc in order to prevent damage to the circuit breaker and/or to limit the above-described dangerous situations.

There have been many proposed devices to quickly quench an arc. One of such common devices comprises an arc splitter stack into which an arc is drawn, with or without arc straps. While such arc splitter stacks often provide the circuit breaker with acceptable arc quenching properties, the advantage comes with several costs, one of them being an increase in required space. By their very nature (i.e., being defined by a series of plates that must be separated by air gaps), arc splitter stacks require significant space within the circuit breaker housing.

This may present potential issues in certain situations. More specifically, as electrical components in general get smaller and smaller, tenths of an inch become more important and, therefore, any shrinking of the dimensions of a circuit breaker is desired. In some situations, it is the depth of the circuit breaker (i.e., the extent to which the circuit breaker extends into the panel) that is an issue, and various low profile designs have been proposed to address these depth concerns. In other situations, it may be the width of the circuit breaker (i.e., measured generally horizontally along the circuit breaker's exposed mounting surface in the typical orientation of a circuit breaker panel) that is important.

Instead, or in addition, however, it may be the height of the circuit breaker (i.e., measured generally vertically along the circuit breaker's exposed mounting surface in the typical orientation of a circuit breaker panel) that is important. The present invention is specifically intended to address this situation. In particular, it is desired to limit the height of the circuit breaker to one-half inch (1.27 cm) or less.

While circuit breakers satisfying this height requirement are known, often these circuit breakers have heretofore been limited to relatively lower voltages. This is true because when components are made smaller to accommodate the reduced overall height of the circuit breaker, heat may become an issue unless the voltage handling capabilities are also reduced. An additionally problem may be related to arc formation and, in particular, arc quenching, if the circuit breaker is made more compact, without also reducing the power handling capabilities of the circuit breaker.

It is therefore desired to provide a circuit breaker design that allows for the circuit breaker to have an overall height (i.e., measured vertically along the circuit breaker's exposed outwardly-facing surface in the typical orientation of circuit breaker panels) that is slimmer than achievable with known typical configurations, while at the same time still providing robust power (e.g., voltage) handling and arc interruption capabilities.

SUMMARY OF THE INVENTION

To this end, a circuit breaker is provided, according to one aspect of the present invention, comprising a housing within which components of the circuit breaker are disposed, a line terminal adapted to be electrically connected to a source of electrical power, a load terminal adapted to be electrically connected to at least one load, a stationary contact positioned within the housing and a moveable contact arm assembly having a generally longitudinal axis and a moveable contact positioned thereon at a first end. The moveable contact arm assembly is pivotably mounted within the housing at a second end and is pivotable about the second end between a closed position in which the moveable contact and the stationary contact are in physical contact and the line terminal and the load terminal are in electrical communication, and an open position in which the moveable contact and the stationary contact are out of physical contact and the line terminal and the load terminal are out of electrical communication. An overcurrent tripping device is operably coupled to the moveable contact arm assembly via a linkage assembly and is adapted to move the moveable contact arm assembly to the open position upon detection of an overcurrent situation. A resetting mechanism is also provided, actuation of which is adapted to, when the moveable contact arm assembly is in the open position, move the moveable contact arm assembly to the closed position, the resetting mechanism extending from, or being accessible through, the outwardly facing exposed surface of the housing. An arc splitter is adapted to quench an arc created between the stationary contact and the moveable contact as the stationary contact and the moveable contact are moveable into and/or out of contact with one another. The resetting mechanism comprises a handle having a hole disposed therein, the hole formed in the handle cooperating with a pin about which the handle is pivotable, and a reinforcing insert operably connected to and pivotable with the handle, the reinforcing insert having a hole disposed therein, the hole formed in the reinforcing insert cooperating with the pin about which the handle is pivotable. A permanent magnet is disposed on the moveable contact arm assembly, the permanent magnet disposed so as to urge an arc created between the stationary contact and the moveable contact toward the arc splitter. The linkage assembly comprises a locking element, engagement of which causes the contact arm assembly to remain in the closed position when moved to the closed position by the resetting mechanism, and a pivotable rotator operably connected to the overcurrent tripping device such that upon detection of an overcurrent situation the overcurrent tripping device causes the rotator to pivot and consequently disengage the locking element, such that the contact arm assembly moves to the open position.

In some embodiments, the housing has an outwardly facing exposed surface having a width and a height, wherein the width is greater than the height, and wherein the height is at most one-half inch.

In some embodiments, the handle is formed from a polymer material and the reinforcing insert is formed from a metal material. In certain of these embodiments, the hole in the metal reinforcing insert inhibits elongation of the hole formed in the polymer handle. In certain embodiments, the pin about which the polymer handle and metal reinforcing insert are pivotable is formed from a metal material, and the hole in the metal reinforcing insert inhibits elongation of the hole formed in the polymer handle, whereby potential melting of the hole in the polymer handle caused by elevated temperature of the metal pin is inhibited.

In some embodiments, the pivotable rotator is formed from a polymer material.

In some embodiments, the permanent magnet is disposed on the moveable contact arm assembly at a location along the generally longitudinal axis between the moveable contact and a point at which the moveable contact arm assembly is pivotably connected with respect to the housing.

In some embodiments, actuation of the resetting mechanism is further adapted to manually move the moveable contact arm assembly between the closed position and a second open position. In certain of these embodiments, the handle has a portion thereof extending from the housing adapted to be actuated by a user.

In some embodiments, the arc splitter comprises a plurality of spaced apart conductive plates disposed within the housing.

In accordance with another aspect of the present invention, a circuit breaker comprises a housing within which components of the circuit breaker are disposed, a line terminal adapted to be electrically connected to a source of electrical power, a load terminal adapted to be electrically connected to at least one load, a stationary contact positioned within the housing and a moveable contact arm assembly having a generally longitudinal axis and a moveable contact positioned thereon at a first end. The moveable contact arm assembly is pivotably mounted within the housing at a second end and is pivotable about the second end between a closed position in which the moveable contact and the stationary contact are in physical contact and the line terminal and the load terminal are in electrical communication, and an open position in which the moveable contact and the stationary contact are out of physical contact and the line terminal and the load terminal are out of electrical communication. An overcurrent tripping device is operably coupled to the moveable contact arm assembly via a linkage assembly and is adapted to move the moveable contact arm assembly to the open position upon detection of an overcurrent situation. A resetting mechanism is also provided, actuation of which is adapted to, when the moveable contact arm assembly is in the open position, move the moveable contact arm assembly to the closed position, the resetting mechanism extending from, or being accessible through, the outwardly facing exposed surface of the housing. An arc splitter is adapted to quench an arc created between the stationary contact and the moveable contact as the stationary contact and the moveable contact are moveable into and/or out of contact with one another. The resetting mechanism comprises a handle having a hole disposed therein, the hole formed in the handle cooperating with a pin about which the handle is pivotable, and a reinforcing insert operably connected to and pivotable with the handle, the reinforcing insert having a hole disposed therein, the hole formed in the reinforcing insert cooperating with the pin about which the handle is pivotable.

In some embodiments, the housing has an outwardly facing exposed surface having a width and a height, wherein the width is greater than the height, and wherein the height is at most one-half inch.

In some embodiments, the handle is formed from a polymer material and the reinforcing insert is formed from a metal material. In certain of these embodiments, the hole in the metal reinforcing insert inhibits elongation of the hole formed in the polymer handle. In certain embodiments, the pin about which the polymer handle and metal reinforcing insert are pivotable is formed from a metal material, and the hole in the metal reinforcing insert inhibits elongation of the hole formed in the polymer handle, whereby potential melting of the hole in the polymer handle caused by elevated temperature of the metal pin is inhibited.

In some embodiments, the circuit breaker further comprises a permanent magnet disposed on the moveable contact arm assembly, the permanent magnet disposed so as to urge an arc created between the stationary contact and the moveable contact toward the arc splitter.

In some embodiments, the linkage assembly comprises a locking element, engagement of which causes the contact arm assembly to remain in the closed position when moved to the closed position by the resetting mechanism, and a pivotable rotator operably connected to the overcurrent tripping device such that upon detection of an overcurrent situation the overcurrent tripping device causes the rotator to pivot and consequently disengage the locking element, such that the contact arm assembly moves to the open position.

In accordance with a further aspect of the present invention, a circuit breaker comprises a housing within which components of the circuit breaker are disposed, a line terminal adapted to be electrically connected to a source of electrical power, a load terminal adapted to be electrically connected to at least one load, a stationary contact positioned within the housing, and a moveable contact arm assembly having a generally longitudinal axis and a moveable contact positioned thereon at a first end, the moveable contact arm assembly being pivotably mounted within the housing at a second end and being pivotable about the second end between a closed position in which the moveable contact and the stationary contact are in physical contact and the line terminal and the load terminal are in electrical communication, and an open position in which the moveable contact and the stationary contact are out of physical contact and the line terminal and the load terminal are out of electrical communication. An overcurrent tripping device is operably coupled to the moveable contact arm assembly via a linkage assembly and is adapted to move the moveable contact arm assembly to the open position upon detection of an overcurrent situation. A resetting mechanism is provided, actuation of which is adapted to, when the moveable contact arm assembly is in the open position, move the moveable contact arm assembly to the closed position, the resetting mechanism extending from, or being accessible through, the outwardly facing exposed surface of the housing. An arc splitter is adapted to quench an arc created between the stationary contact and the moveable contact as the stationary contact and the moveable contact are moveable into and/or out of contact with one another. A permanent magnet is disposed on the moveable contact arm assembly, the permanent magnet disposed so as to urge an arc created between the stationary contact and the moveable contact toward the arc splitter. The permanent magnet is disposed on the moveable contact arm assembly at a location along the generally longitudinal axis between the moveable contact and a point at which the moveable contact arm assembly is pivotably connected with respect to the housing.

In some embodiments, the housing has an outwardly facing exposed surface having a width and a height, wherein the width is greater than the height, and wherein the height is at most one-half inch.

In some embodiments, the resetting mechanism comprises a handle having a hole disposed therein, the hole formed in the handle cooperating with a pin about which the handle is pivotable, and a reinforcing insert operably connected to and pivotable with the handle, the reinforcing insert having a hole disposed therein, the hole formed in the reinforcing insert cooperating with the pin about which the handle is pivotable.

In some embodiments, the linkage assembly comprises a locking element, engagement of which causes the contact arm assembly to remain in the closed position when moved to the closed position by the resetting mechanism, and a pivotable rotator operably connected to the overcurrent tripping device such that upon detection of an overcurrent situation the overcurrent tripping device causes the rotator to pivot and consequently disengage the locking element, such that the contact arm assembly moves to the open position.

In accordance another aspect of the present invention, a circuit breaker comprises a housing within which components of the circuit breaker are disposed, a line terminal adapted to be electrically connected to a source of electrical power, a load terminal adapted to be electrically connected to at least one load, a stationary contact positioned within the housing, and a moveable contact arm assembly having a generally longitudinal axis and a moveable contact positioned thereon at a first end, the moveable contact arm assembly being pivotably mounted within the housing at a second end and being pivotable about the second end between a closed position in which the moveable contact and the stationary contact are in physical contact and the line terminal and the load terminal are in electrical communication and an open position in which the moveable contact and the stationary contact are out of physical contact and the line terminal and the load terminal are out of electrical communication. An overcurrent tripping device is operably coupled to the moveable contact arm assembly via a linkage assembly and is adapted to move the moveable contact arm assembly to the open position upon detection of an overcurrent situation. A resetting mechanism is provided, actuation of which is adapted to, when the moveable contact arm assembly is in the open position, move the moveable contact arm assembly to the closed position, the resetting mechanism extending from, or being accessible through, the outwardly facing exposed surface of the housing. An arc splitter is adapted to quench an arc created between the stationary contact and the moveable contact as the stationary contact and the moveable contact are moveable into and/or out of contact with one another. The linkage assembly comprises a locking element, engagement of which causes the contact arm assembly to remain in the closed position when moved to the closed position by the resetting mechanism, and a pivotable rotator operably connected to the overcurrent tripping device such that upon detection of an overcurrent situation the overcurrent tripping device causes the rotator to pivot and consequently disengage the locking element, such that the contact arm assembly moves to the open position. The pivotable rotator is formed from a polymer material.

In some embodiments, the housing has an outwardly facing exposed surface having a width and a height, wherein the width is greater than the height, and wherein the height is at most one-half inch.

In some embodiments, the resetting mechanism comprises a handle having a hole disposed therein, the hole formed in the handle cooperating with a pin about which the handle is pivotable, and a reinforcing insert operably connected to and pivotable with the handle, the reinforcing insert having a hole disposed therein, the hole formed in the reinforcing insert cooperating with the pin about which the handle is pivotable.

In some embodiments, the circuit breaker further comprises a permanent magnet disposed on the moveable contact arm assembly, the permanent magnet disposed so as to urge an arc created between the stationary contact and the moveable contact toward the arc splitter.

The present invention thus provides a circuit breaker design that allows for the circuit breaker to have an overall height (i.e., measured vertically along the circuit breaker's exposed outwardly-facing surface in the typical orientation of circuit breaker panels) that is slimmer than achievable with known typical configurations, while at the same time still providing robust power (e.g., voltage) handling and arc interruption capabilities.

Other objects of the invention and its particular features and advantages will become more apparent from consideration of the following drawings and accompanying detailed description.

DETAILED DESCRIPTION OF THE INVENTION

Figure 1:
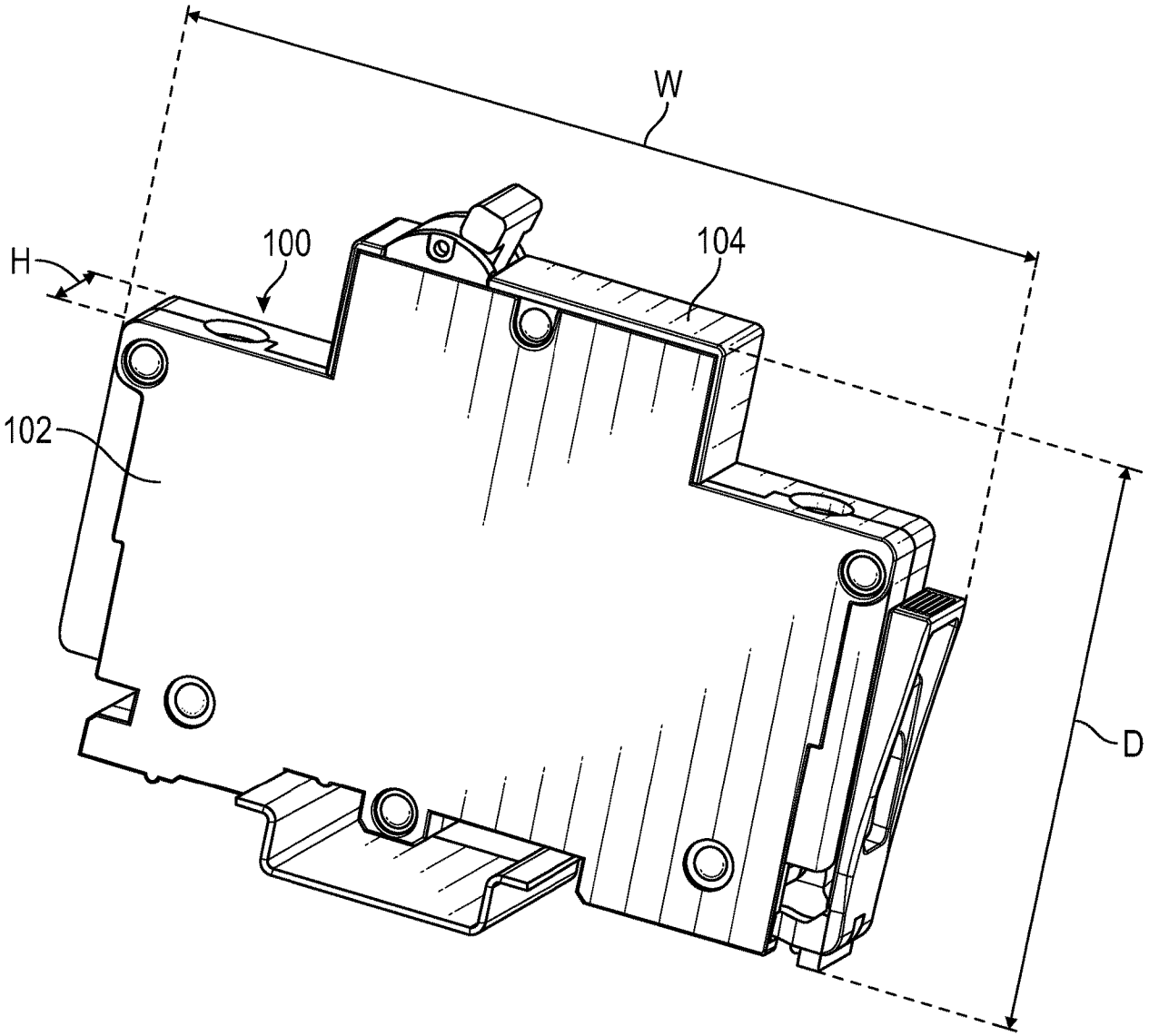
FIG. 1 is a side isometric view illustrating the outside housing of an exemplary circuit breaker constructed in accordance with the present invention.

Referring now to the drawings, wherein like reference numerals designate corresponding structure throughout the views.

FIG. 1 illustrates the exterior of an example circuit breaker (100) having an improved design that allows for the circuit breaker (100) to have a slim profile.

More specifically, circuit breaker (100) is provided with a housing (102) that contains the working elements of the device therein. The housing (102) has an exposed outwardly facing surface (104) that would remain visible to a user when the circuit breaker (100) is installed in a circuit breaker panel in a well-known manner. The housing (102) defines a depth (D) of the circuit breaker (100) (i.e., the extent to which the circuit breaker extends into the panel), a width (W) of the circuit breaker (100) (i.e., measured generally horizontally along the circuit breaker's exposed mounting surface in the typical orientation of a circuit breaker panel), and a height (H) of the circuit breaker (100) (i.e., measured generally vertically along the circuit breaker's exposed mounting surface in the typical orientation of a circuit breaker panel).

As discussed above, The present invention is specifically concerned with providing a slim design, wherein it is the height (H) of the circuit breaker (100) that is of particular concern. In particular, it is desired to limit the height (H) of the circuit breaker (100) to one-half inch (1.27 cm) or less, while at the same time still providing robust power (e.g., voltage) handling and arc interruption capabilities.

Figure 2:
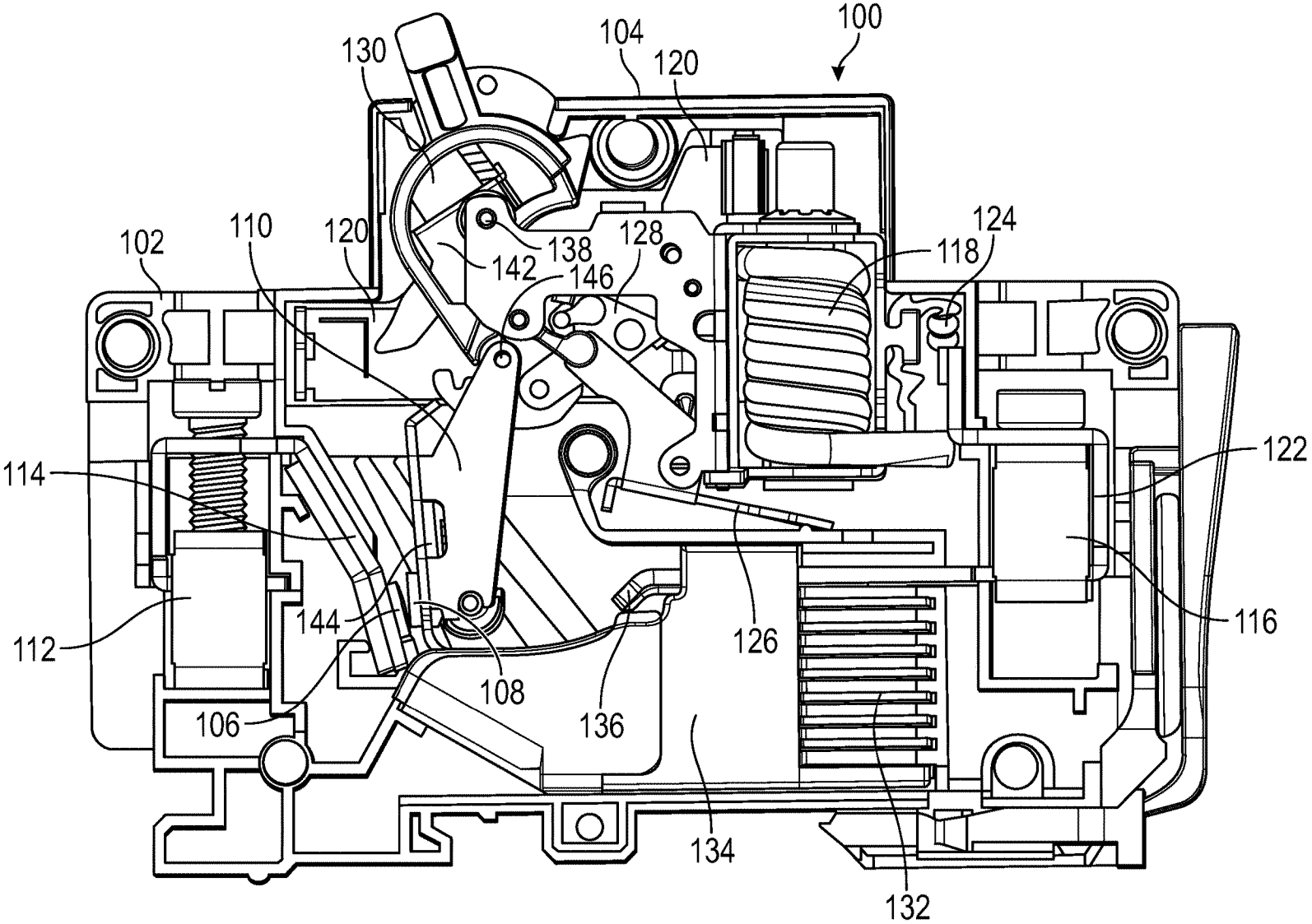
FIG. 2 is a side elevational view, partially broken away, of the exemplary circuit breaker constructed in accordance with the present invention as shown in FIG. 1, shown with the contacts in the closed position so that the circuit breaker is in an on state.
Figure 3:
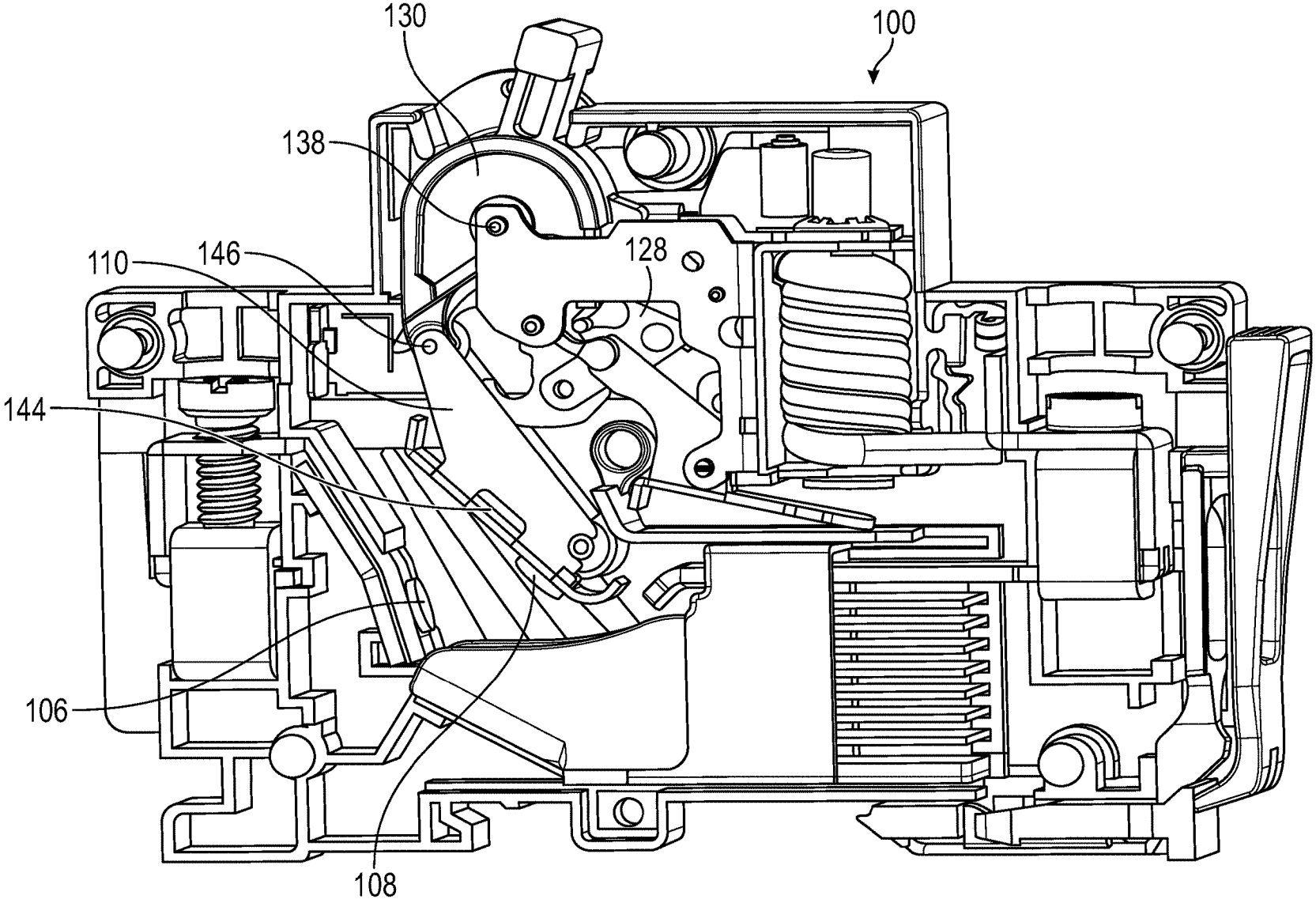
FIG. 3 is a side elevational view, partially broken away, of the exemplary circuit breaker constructed in accordance with the present invention as shown in FIGS. 1 and 2, shown with the contacts in the open position so that the circuit breaker is in an off state.

Referring now to FIGS. 2 and 3, the circuit breaker (100) is further provided with a set of contacts including a stationary contact (106) and movable contact (108). The moveable contact (108) is positioned on a moveable contact arm assembly (110), and the moveable contact (108) is configured to move between an open and closed position relative to the stationary contact (106). FIG. 2 shows the contacts (106, 108) in the closed position where electrical current flows therebetween, whereas FIG. 3 shows the contacts (106, 108) in the open position, where no electrical current flows therebetween.

Also shown in FIG. 2 is a "line" terminal (112), which is designed to be connected to a source of electrical power (not shown). Stationary contact (106) is mounted onto a first conductive element (114), which in turn is electrically connected to line terminal (112).

Also provided is a "load" terminal (116), which is designed to be connected to the electrical components (not shown) being fed from the circuit breaker, such as an individual component connected directly to a circuit breaker (e.g., an air conditioner unit), or multiple components through a power wire which terminates at electrical outlets.

Moveable contact (108) mounted on moveable contact arm assembly (110) is in indirect electrical communication with the load terminal (116). More specifically, the moveable contact arm assembly (110), which is electrically conductive, is in electrical communication with an input side of an overcurrent tripping device (118) through a conductive connector (120) via a not shown flexible conductive element, such as a braided wire, connected on one end to the moveable contact arm assembly (110) and on the other end to the conductive connected (120) (as is conventional). An output side of the overcurrent tripping device (118) is in electrical communication with a second conductive element (122) through a conductive connector (124), with the load terminal (116) being in electrical communication with the second conductive element (122).

In operation, and when the circuit breaker (100) is in the "on" state (i.e., when the stationary contact (106) and the moveable contact (108) are closed and thereby in electrical communication), electrical power is input into circuit breaker (100) via line terminal (112) and exits the circuit breaker (100) via the load terminal (116). The flow of electricity through the circuit breaker will now be discussed.

Electrical power flows into the circuit breaker (100) through line terminal (112), and then passes through first conductive element (114) to stationary contact (106). The contacts being closed, the electrical power flows through moveable contact (108), through conductive contact arm assembly (110), through conductive connector (120) and to the input side of overcurrent tripping device (118). The electrical power then flows out the output side of the overcurrent tripping device (118) through conductive connector (124), through second conductive element (122), exiting the circuit breaker through load terminal (116).

If the electrical current exceeds a threshold level, overcurrent tripping device (118) will function to "trip" the circuit breaker (100) by opening the circuit, opening the contacts relative to each other by means of a trip mechanism (126) (i.e., armature) and linkage assembly (128) such that the flow of electrical current through the contacts (106, 108) ceases. In the event that the electrical current does not exceed the threshold level set by overcurrent tripping device (118), the electrical power is allowed to pass through load terminal (116), which in turn, provides electrical power to the connected circuit and/or equipment.

The circuit breaker (100) also includes a resetting mechanism (130) adapted to reset the circuit breaker (100) and move the moveable contact (108) into physical contact with the stationary contact (106) by movement of the moveable contact arm assembly (110). The resetting mechanism (130) is connected to the linkage assembly (128), which in turn, is connected to the moveable contact arm assembly (110) for this purpose. The resetting mechanism (130) may also be used to manually open and close the contacts (106, 108), i.e., to turn the circuit breaker (100) on and off, as is known in the art. In the exemplary embodiment shown, the resetting mechanism (130) takes the form of a handle-type actuator, discussed in further detail below.

Referring again specifically to FIG. 2, the circuit breaker (100) is shown in the "on" position, where the contacts (106, 108) are closed. As is known, when the circuit breaker (100) is manually turned off or when an overcurrent situation is sensed, the contacts (106, 108) are caused to open, to thereby cease the flow of electrical power through the circuit breaker (100). However, also as is known, although moveable contact (108) has separated from stationary contact (106), electricity, in the form of an arc (not shown) may still flow from electrical contact (106) to electrical contact (108) for a period of time. The arc may be capable of jumping between electrical contacts, through air, and can cause severe damage to both contacts (106, 108).

In a worst case scenario, a single arc can damage the contacts so severely as to render them inoperable during normal operation. However, even when such is not the case, the arc may create heat (particularly, in the case of the present invention, where it is desired to provide a slimmer design than is typical, requiring a compact arrangement of parts), which may damage various components over time. To protect electrical contacts (106, 108), and circuit breaker (100) overall, any created arc must be extinguished as quickly as possible. This may be done by pushing the arc into an arc splitter (132) disposed within an arc chamber (134).

The arc splitter (132) may take the form of a plurality of spaced apart, generally metallic, plates which draw the arc in, and cool and quench the arc. Each plate may be spaced apart at the same distance, or the distance between each plate may vary depending on the application of circuit breaker. For example, each plate may be spaced apart approximately 0.8 inches from the next plate, or the distance between each plate (may be varied. For example, the plates toward one side of the housing may be closer together than the plates towards the other side of the housing, or vice versa.

Additionally, one or more arc straps (136) may be provided in order to provide a safe place for the arc to jump prior to the arc being fully extinguished. In the shown example, arc strap (136) is in electrical communication with the load terminal (116), although an arc strap in communication with the line terminal may be provided instead of, or in addition to, the illustrated arc strap (136).

As briefly noted above, the housing (102) of the circuit breaker (100) includes an outwardly facing exposed surface (104) through which the resetting mechanism (130) extends and/or is accessible by a user. As will be understood by those skilled in the art, circuit breakers of the type discussed herein are configured to be inserted into panels with a plurality of other circuit breaker (at least some of which are typically identical to others). A typical home, for example, has at least one, and perhaps two, three or even more, such panels, each of which may include 10, 20 or even more circuit breakers. Also as is understood by those skilled in the art, generally only one surface of each of the circuit breakers (i.e., the one carrying the resetting mechanism) is exposed. This outwardly facing exposed surface (shown as 104 in FIG. 1) generally defines at least one plane. Typically, all of the circuit breakers disposed in each panel have their outwardly facing exposed surface lying in the same plane.

As discussed, one of the objects of the present invention is to provide a circuit breaker design having a height (H), which is narrower than is typically achievable in circuit breakers of the type disclosed. The reason that the terms "height" is used herein is because circuit breakers are typically disposed in panels such that the line terminal (112) and the load terminal (116) are disposed generally horizontally, with multiple circuit breakers being stacked one on top of another such that the line terminals (112) of the stacked circuit breakers are generally vertically aligned and the load terminals (116) of the stacked circuit breakers are generally vertically aligned. With respect to the embodiment shown in FIGS. 1-3, this would mean that the handle-type actuator resetting mechanism (130) would be moveable horizontally left-to-right and right-to-left when facing the panel of circuit breakers. Typically, a panel for residential use includes two stacks of circuit breakers.

Preferably, the height (H) of the circuit breaker (100), including the outwardly facing exposed surface (104) is at most one-half inch (1.27 cm). While circuit breakers satisfying this height limitation are known, often these circuit breakers have heretofore been limited to relatively lower voltages. This is true because when components are made smaller to accommodate the reduced overall height of the circuit breaker, heat may become an issue unless the voltage handling capabilities are also reduced. An additional problem may be related to arc formation and, in particular, arc quenching, if the circuit breaker is made more compact, without also reducing the power handling capabilities of the circuit breaker. Ways in which the reduced height (H) of circuit breaker (100) can be achieved in accordance with the present invention, while still being able to employ such circuit breakers in connection with relatively higher voltages, will now be discussed.

Figure 4:
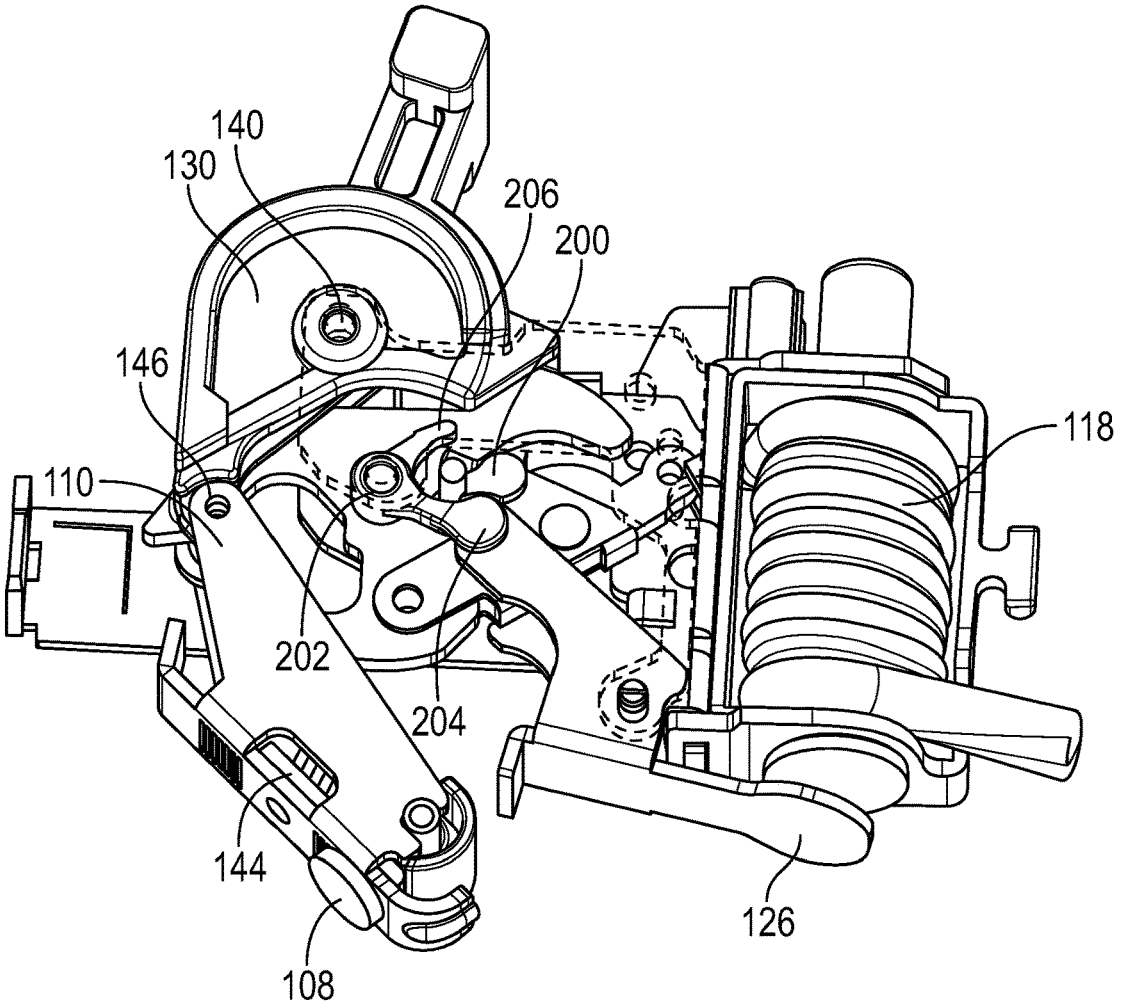
FIG. 4 is a side isometric view, partially broken away, of portions of the exemplary circuit breaker constructed in accordance with the present invention as shown in FIGS. 1-3, illustrating in greater detail certain aspects of the present invention, including the linkage mechanism and the moveable contact arm assembly thereof.

Referring now specifically to FIG. 4, portions of the circuit breaker (100), including portions of the linkage assembly (128) and the moveable contact arm (110), are shown in greater detail with various portions being removed for clarity.

As shown, the linkage assembly (128) includes a number of conventional components which are very well known in the art, such that the configuration and operation thereof will not be discussed in detail. What is relevant to the present invention, however, is that the linkage assembly (128) includes a locking element (200), engagement of which causes the contact arm assembly (110) to remain in the closed position when moved to the closed position by the resetting mechanism (130). The linkage assembly also includes pivotable rotator (202) operably connected to the overcurrent tripping device (118) such that upon detection of an overcurrent situation the overcurrent tripping device (118) causes the rotator (202) to pivot and consequently disengage the locking element (200), such that the contact arm assembly (110) moves to the open position.

More specifically, the rotator (202) is pivotably connected at one end thereof (204) to the trip mechanism (126) portion of the overcurrent tripping device (118), while another end of the rotator (202) is provided with a hook-like member (206). Upon detection of an overcurrent situation the overcurrent tripping device (118) causes trip mechanism (126) to pivot, thereby causing corresponding pivoting of the rotator (202) via its cooperation with end (204), such that the hook-like member (206) is caused to disengage the locking element (200), such that the contact arm assembly (110) moves to the open position.

In order to at least partially insulate various components of the circuit breaker from one another, and in particular in order to inhibit heat from travelling freely across the entire linkage assembly (128), at least the rotator (202) is formed from a polymer material, such as polypropylene. It has been found that the rotator (202) is a good candidate to act as an insulating element within the linkage assembly (128), since the rotator (202) is not subjected to high stresses, in that it operates primarily to disengage the locking element (200) in the case of an overcurrent situation, which involves relatively low force transmission.

Also formed of a polymer material is the resetting mechanism (130), which is pivotably mounted with respect to the housing about a pin (138) (see FIGS. 2 and 3), which is typically metallic, so as to inhibit wear and provide the structural support required for resetting mechanism (130). However, it has been found that when providing the desired slim features in conjunction with relatively higher voltages, heat transmitted to the pin (138) may cause elongation of the pin-receiving hole (140) (see FIG. 4) provided in resetting mechanism (130), due to melting and/or thermal runaway.

Figure 5:
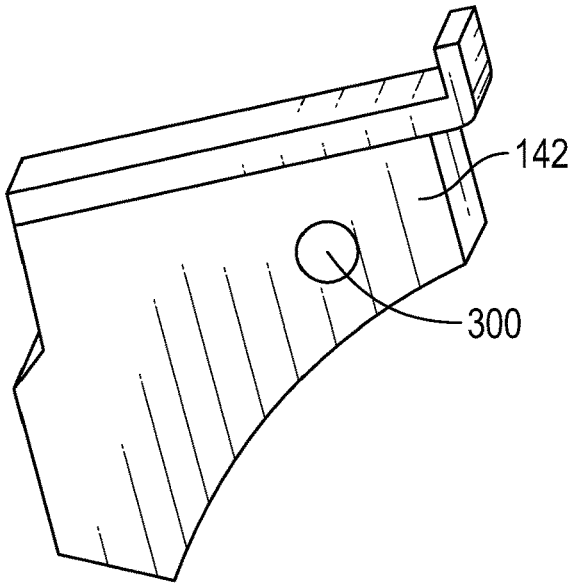
FIG. 5 is a side plan view of a portion of the exemplary circuit breaker constructed in accordance with the present invention as shown in FIGS. 1-4, illustrating in greater detail certain aspects of the present invention, including a handle reinforcing insert thereof.

In order to mitigate these issues, the resetting mechanism (130) is provided with at least one reinforcing insert (142), as best seen in FIGS. 2 and 5. The reinforcing insert (142), which is operably connected to and is pivotable with the resetting mechanism (130), includes a hole (300) disposed therein. The hole (300) in the reinforcing insert (142) is aligned with the pin-receiving hole (140) provided in the resetting mechanism (130), and is sized to pivotably engage the pin (138) about which the resetting mechanism (130) is pivotable in a known manner. The reinforcing insert (142) is formed from a metal material, such that potential melting of the hole (140) formed in the polymer resetting mechanism (130) caused by elevated temperature of the metal pin (138) is inhibited.

The creation of heat is further mitigated by aiding in the quenching of any created arcs as quickly as possible. This is achieved in accordance with the present invention by the provision of a permanent magnet (144) to aid in urging the arc toward the arc splitter (132). While the use of permanent magnets for this purpose is well-known (such that the principles of operation behind their use is not discussed in detail herein), the present invention distinguishes itself from heretofore known designs by positioning the permanent magnet (144) on the moveable contact arm assembly (110). In particular, the permanent magnet (144) is disposed on the moveable contact arm assembly (110) at a location along a generally longitudinal axis of the contact arm assembly (110) between the moveable contact (108) and a point (146) at which the moveable contact arm assembly (110) is pivotably connected with respect to said housing (102).

Thus, with this placement of the permanent magnet (144), as the moveable contact arm assembly (110) opens toward the arc splitter (132), with any created arc also consequently moving toward the arc splitter (132), the moveable permanent magnet (144) also moves toward the arc splitter (132), along with the arc. This movement of the permanent magnet (144) in the same direction as the arc means that the relative distance between the permanent magnet (144) and the arc remains smaller than it would if the permanent magnet was stationary for the entire travel of the arc, resulting in a greater force urging the arc toward the arc splitter (132), since the magnitude of the force of the magnet on the arc is directly related to the distance between the magnet and the arc. As such, arc quenching is enhanced.

Although the invention has been described with reference to a particular arrangement of parts, features and the like, these are not intended to exhaust all possible arrangements or features, and indeed many other modifications and variations will be ascertainable to those of skill in the art.

What is claimed is:

1. A circuit breaker comprising:

a housing within which components of the circuit breaker are disposed;

a line terminal adapted to be electrically connected to a source of electrical power;

a load terminal adapted to be electrically connected to at least one load;

a stationary contact positioned within the housing;

a moveable contact arm assembly having a generally longitudinal axis and a moveable contact positioned thereon at a first end, the moveable contact arm assembly being pivotably mounted within the housing at a second end, an entirety of the movable contact arm assembly being pivotable about the second end between a closed position in which the moveable contact and the stationary contact are in physical contact and the line terminal and the load terminal are in electrical communication, and an open position in which the moveable contact and the stationary contact are out of physical contact and the line terminal and the load terminal are out of electrical communication;

an overcurrent tripping device operably coupled to the moveable contact arm assembly via a linkage assembly and adapted to move the moveable contact arm assembly to the open position upon detection of an overcurrent situation;

a resetting mechanism, actuation of which is adapted to, when the moveable contact arm assembly is in the open position, move the moveable contact arm assembly to the closed position, the resetting mechanism extending from, or being accessible through, an outwardly facing exposed surface of the housing; and an arc splitter adapted to quench an arc created between the stationary contact and the moveable contact as the stationary contact and the moveable contact are moveable into and/or out of contact with one another;

wherein the resetting mechanism comprises:

a handle having a hole disposed therein, the hole formed in the handle cooperating with a pin about which the handle is pivotable; and a reinforcing insert operably connected to and pivotable with the handle, the reinforcing insert having a hole disposed therein, the hole formed in the reinforcing insert cooperating with the pin about which the handle is pivotable;

a permanent magnet disposed on the moveable contact arm assembly, the permanent magnet disposed so as to urge an arc created between the stationary contact and the moveable contact toward the arc splitter; and wherein the linkage assembly comprises:

a locking element, engagement of which causes the contact arm assembly to remain in the closed position when moved to the closed position by the resetting mechanism; and a pivotable rotator formed from a polymer material and operably connected to the overcurrent tripping device such that upon detection of an overcurrent situation the overcurrent tripping device causes the rotator to pivot and consequently disengage the locking element, such that the contact arm assembly moves to the open position, wherein the rotator is pivotably connected at one end to a trip mechanism portion of the overcurrent tripping device and terminates at another end in a hook-like member, wherein the hook-like member engages and retains the locking element during normal operation and disengages and release the locking element upon detection of an overcurrent situation.

2. The circuit breaker of claim 1, wherein the outwardly facing exposed surface of the housing has a width and a height, wherein the width is greater than the height, and wherein the height is at most one-half inch.

3. The circuit breaker of claim 1, wherein the handle is formed from a polymer material and wherein the reinforcing insert is formed from a metal material.

4. The circuit breaker of claim 3 wherein the hole in the reinforcing insert inhibits elongation of the hole formed in the polymer handle.

5. The circuit breaker of claim 4 wherein the pin about which the polymer handle and the reinforcing insert are pivotable is formed from a metal material, and wherein the hole in the reinforcing insert inhibits elongation of the hole formed in the polymer handle, whereby potential melting of the hole in the polymer handle caused by elevated temperature of the metal pin is inhibited.

6. The circuit breaker of claim 1 wherein the permanent magnet is disposed on the moveable contact arm assembly at a location along the generally longitudinal axis between the moveable contact and a point at which the moveable contact arm assembly is pivotably connected with respect to the housing.

7. The circuit breaker of claim 1, wherein the handle has a portion thereof extending from the housing adapted to be actuated by a user.

8. The circuit breaker of claim 1 wherein the arc splitter comprises a plurality of spaced apart conductive plates disposed within the housing.

* * * * *